US005119427A

United States Patent [19]

Hersh et al.

[11] Patent Number: 5,119,427

[45] Date of Patent: Jun. 2, 1992

[54] EXTENDED FREQUENCY RANGE HELMHOLTZ RESONATORS

[76] Inventors: Alan S. Hersh, 10707 Overman Ave., Chatsworth, Calif. 91311; Jin Tso, 15036 Hesby St., Sherman Oaks, Calif. 91403

[21] Appl. No.: 167,886

[22] Filed: Mar. 14, 1988

[51] Int. Cl.[5] ..... G10K 11/16

[52] U.S. Cl. ..... 381/71

[58] Field of Search ..... 381/71, 94, 96

[56] References Cited

U.S. PATENT DOCUMENTS

| | | | |
|---|---|---|---|
| 3,826,870 | 7/1974 | Wurm et al. | 381/71 |
| 3,936,606 | 2/1976 | Wanke | 381/71 |
| 4,480,333 | 10/1984 | Ross | 381/71 |
| 4,490,841 | 12/1984 | Chaplin et al. | 381/71 |
| 4,527,282 | 7/1985 | Chaplin et al. | 381/71 |
| 4,549,289 | 10/1985 | Schwartz et al. | 381/71 |
| 4,594,695 | 6/1986 | Garconnat et al. | 381/71 |
| 4,596,033 | 6/1986 | Swinbanks | 381/71 |
| 4,653,102 | 3/1987 | Hansen | 381/94 |
| 4,665,549 | 5/1987 | Eriksson et al. | 381/71 |
| 4,677,676 | 6/1987 | Eriksson | 381/71 |

*Primary Examiner*—Forester W. Isen

*Attorney, Agent, or Firm*—Blakely, Sokoloff, Taylor & Zafman

[57] ABSTRACT

Extended frequency range Helmholtz resonators particularly useful for sound absorption over a relatively wide frequency range are disclosed. The resonators are conventional Helmholtz resonators with the addition of an active acoustic driver in the resonator cavity driven at appropriate amplitudes, frequencies and phases to provide a high degree of absorption of sound not only at the resonant frequency of the resonator, but for substantial frequency bands above and below the resonant frequency. To provide the active drive to the acoustic driver in the resonant cavity, one or more microphones are used to detect the sound to be absorbed, which signal is processed and amplified to provide a drive to the acoustic driver to best absorb the incoming sound. Various embodiments are disclosed.

33 Claims, 3 Drawing Sheets

EXTENDED FREQUENCY RANGE HELMHOLTZ RESONATORS

BACKGROUND OF THE INVENTION

1. Field of the Invention

The present invention relates to the field of sound absorption devices.

2. Prior Art

Resonators were first used by the ancient Greeks to reduce echoes in their large open air theaters. By the thirteenth century, resonators were used in churches in Sweden and Denmark, centuries before Helmholtz developed the first mathematical model of their behavior. Helmholtz resonators, as they are now known today, are currently being used as sound absorbing devices in a variety of commercial applications, including aircraft engines, auditoriums, concert halls and in compressor inlet and exhaust mufflers.

The classical Helmholtz resonator comprises an air cavity coupled to the outside space through some form of opening such as an orifice, slot, tube, or the like. The compressibility of the air within the cavity acts as a spring, with the air flowing in the opening acting as a mass so that the system will be tuned as a spring-mass system to an acoustic frequency dependent upon these two parameters.

When Helmholtz resonators are driven with acoustic energy at the resonant frequency, the resonators will absorb a maximum amount of the incoming acoustic energy. However, because they are tuned systems, the absorption decreases rapidly as the frequency of the incoming acoustic energy varies substantially from the resonant frequency. Thus the principle limitation of these devices is that they absorb sound energy efficiently only within a narrow frequency range centered at their tuned frequency. Therefore they can control only one acoustic mode excited at a single frequency. While this is suitable for some applications, such as rotating machinery which operates at a substantially constant angular velocity, it is far from ideal for equipment such as aircraft engines whose angular velocity may vary substantially between waiting for take off instructions, take off conditions, cruise and approach conditions. In that regard, in general the noise emitted by jet engines includes not only the reasonably white noise in the exhaust, but further includes components which are directly proportional to engine speed, and many strong components which are harmonics of engine speed, such as turbine blade passing frequencies, etc.

One approach to this problem is disclosed in U. S. Pat. No. 3,972,383. That patent discloses a system for varying the acoustic resistance of an acoustical lining disposed in a duct of an air propulsar. The system comprises a nonlinear sound suppression liner having a porous facing sheet overlying a plurality of cells, and means for impinging a predetermined oscillatory air pressure signal of 100–160 db at an inaudible frequency on the facing sheet to vary the acoustic resistance of the facing sheet to make it optimum for a selected sound level and air flow condition in the duct. It would appear that the result achieved is similar to that which would result from being able to mechanically adjust the openings of the liner, namely to change the frequency for best absorption of the liner as may be required for the variations occurring between take off, cruise and approach. Such an arrangement, however, would not broaden the frequency band for best absorption, thereby allowing one resonator to absorb a plurality of frequencies over a reasonable band at one time, a primary objective of the present invention.

In addition to the forgoing, various other types of active noise control techniques, generally in the form of noise cancellation techniques, are also well known. In accordance with these techniques, a microphone is used to sense sound, normally a single tone being emitted by the noise source, with the microphone signal being amplified and phase shifted an appropriate amount to power a driver to generate an equal and opposite sound component of appropriate phase to cancel the original sound. In certain applications and under appropriate conditions, substantial sound cancellation may be achieved in this manner. However, such a technique has certain limitations which in various applications are either undesirable or in some instances preclude the use thereof. By way of example, the power requirements both in terms of power itself and the required support equipment are very substantial, as the acoustic energy which must be generated must equal that to be cancelled, which may be quite high for large equipment such as turbines and the like. Further, the acoustic driver or drivers essentially form part of the wall of a duct or other chamber associated with the noise source, and accordingly the technique is not very compatible with circular ducts or particularly ducts having compound curvatures and the like. Also, in many applications the environment is too hostile for an acoustic driver to form a portion of a duct wall therein, such as by way of example, jet engine exhaust, rocket engine exhaust and the like. The present invention, as shall subsequently be seen, is not subject to the same limitations, as it requires much less power than the foregoing techniques and can be made compatible with, and therefore is applicable to, engine exhaust and the suppression of noise therein.

BRIEF SUMMARY OF THE INVENTION

Extended frequency range Helmholtz resonators particularly useful for sound absorption over a relatively wide frequency range are disclosed The resonators are conventional Helmholtz resonators with the addition of an active acoustic driver in the resonator cavity driven at appropriate amplitudes, frequencies and phases to provide a high degree of absorption of sound not only at the resonant frequency of the resonator, but for substantial frequency bands above and below the resonant frequency. To provide the active drive to the acoustic driver in the resonant cavity, one or more microphones are used to detect the sound to be absorbed, which signal is processed and amplified to provide a drive to the acoustic driver to best absorb the incoming sound. Various embodiments are disclosed.

DETAILED DESCRIPTION OF THE INVENTION

Figure 1:
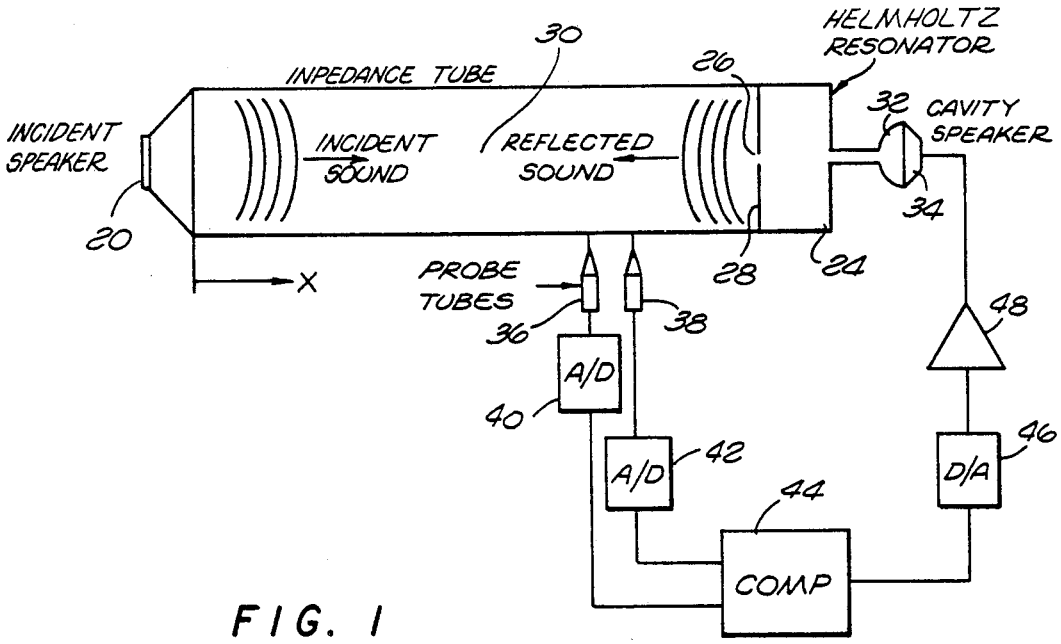
FIG. 1 is a block diagram illustrating a basic configuration for the extended frequency range Helmholtz resonators of the present invention.

First referring to FIG. 1, a block diagram illustrating the basic concept of the present invention ma be seen. In this figure, a sound source 20 generates sound at one end of enclosure 22, which sound will propagate toward a Helmholtz resonator at the opposite end of the enclosure. The resonator is comprised of a resonator cavity 24 and an opening 26 in the cover plate 28 separating the resonator cavity 24 from the internal volume 30 of the enclosure 22. Coupled to the resonator enclosure 24 is a speaker 34. A pair of microphones 36 and 38 are coupled to the enclosure 22 to detect the sound waves therein and provide signals to the analog to digital converters 40 and 42, respectively. The output of the converters is coupled to a digital computer 44 which takes the Fast Fourier transform of each signal, combines the two results in a well-known manner, to separate the incident and reflected waves, applies an appropriate algorithm to the result and provides an output based thereon which is converted to an analog signal by a digital to analog converter 46 and amplified by amplifier 48 to drive the speaker 34 to feed acoustic energy into the cavity 24 of the Helmholtz resonator.

In operation with the electronics turned off, sound from sound source 20 will be incident upon the Helmholtz resonator. If the frequency of the sound is equal to the tuned frequency of the resonator, the resonator will be highly excited, absorbing a substantial portion of the incident acoustic energy. If, on the other hand, the frequency of the acoustic energy incident to the Helmholtz resonator is substantially different from the tuned frequency of the resonator, the resonator will not be significantly excited and the incident sound will be merely reflected without substantial energy loss. With the electronics turned on, however, the frequency and phase of the incident sound is picked up by microphones 36 and 38 and coupled to the computer 44 through the analog to digital converters 40 and 42. In the preferred embodiment, the computer 44 combines the Fast Fourier transforms of the two signals and determines the optimum drive through speaker 34 to best absorb the incoming sound energy. In a simple geometric configuration one can calculate a appropriate algorithm for combining the Fast Fourier transforms and for determining the best cavity speaker drive for maximum sound suppression (acoustic energy absorption) based upon the location and separation of the microphones and various other physical and acoustic parameters of the system. In that regard, as shall be shown later, the phase of the signal applied to the resonator cavity speaker 34 should be within +or−30 degrees, and preferably + or −15 degrees of the ideal phase angle to achieve near maximum sound absorption. On the other hand, the wave length of sound at 1 KHz is approximately 1.1 feet, with the distance giving a 15 degree phase shift at 1 KHz being approximately 0.5 inches. These distances of course are inversely proportional to frequency, so that at higher frequencies, the corresponding distances are even less. Accordingly, it may be seen that the algorithm for the best resonant cavity speaker drive will be highly dependent upon the precise geometries and locations of elements of the system. Further, while a theoretical algorithm may be readily calculated for very simple geometry systems, an empirically derived transformation between the microphone signals and the speaker drive should optimize the performance in any real situation, and would probably be mandatory in most applications, as geometries commonly found in jet engines, rotating machines, etc., would not readily lend themselves to accurate analysis.

To empirically determine the algorithm in the system of FIG. 1, one can readily utilize a speaker for the sound source 20 and apply a fixed frequency drive thereto. Then in response to this drive the amplitude and phase of the drive to the cavity speaker 34 (the frequency of course being the same as the frequency applied to the speaker) can be varied to determine the phase and amplitude of the drive that provides the best sound attenuation. For a given frequency, the system should be relatively linear, in that increasing or decreasing the amplitude of the incident sound will result in a corresponding increase or decrease in the amplitude of the resonant cavity speaker drive for best absorption, the phase of course remaining the same. Thus a scale factor and phase between the microphone signals and the best resonant cavity speaker drive ma be relatively easily determined for any given frequency. By varying the frequency of the input to the speaker 20 and repeating the tests, a plot of amplitude versus frequency and of phase versus frequency for best absorption may be readily made. While these plots will not be linear, in general they will be well behaved, so that interpolation between points or even mere use of information from the closest data point will provide very close to the best results obtainable. Such information may be used to form a algorithm for the conversion or alternatively, may be used to form a look-up table for the conversion of microphone signals to resonant cavity speaker drive, phases and scale factors. Further, of course, when the incident acoustic energy contains multiple frequency components, the principle of linear superposition will generally apply, so that the best attenuation of the overall sound will occur when the speaker 34 is driven with a composite signal having the same frequency components as the incident sound wave, each frequency component having an amplitude and phase which would provide the best attenuation of that component of the incoming sound if not accompanied by the other frequency components thereof.

In an actual system, the foregoing procedure would probably be modified to use the actual source of the sound desired to be attenuated, with the results of adjusting phase and amplitude of a given frequency on the sound suppression being measured by a sharply filtered microphone output so that amplitude and phase for the suppression of a single frequency or a very narrow band of frequencies can be determined against the total noise background. This may be done for each frequency or narrow band of frequencies of interest by isolating the same, varying the phase and amplitude of the feedback and measuring the results thereof through a microphone output filtered to pass only the noise component to be attenuated. Such tests may be accompanied by a variation in the speed of the equipment in accordance with the variation experienced during norma operation thereof. Further, it is conceivable that in some applications the best suppression of a particular frequency may depend upon other factors as well. By way of specific example, a specific piece of rotating machinery under normal conditions may emit noise from one source at 1,000 Hz and from another source at 1,200 Hz, both components of noise being addressable for suppression purposes by a single resonator. Under other conditions however, the speed of the equipment may decrease, and the 1,200 Hz noise may decrease in frequency to 1,000 Hz. Because this noise is originating from a different cause or source than the original 1,000 Hz noise, the conditions for best attenuation thereof may be quite different from that of the best attenuation of the original 1,000 Hz noise. Consequently, while in many cases the microphone signals alone can be used to provide the drive for best attenuation, there may be applications where additional inputs of such parameters as angular velocity of the equipment, environmental conditions, pressures, etc. may also be used as inputs to further tailor the drive for variations in these conditions.

Figure 2:
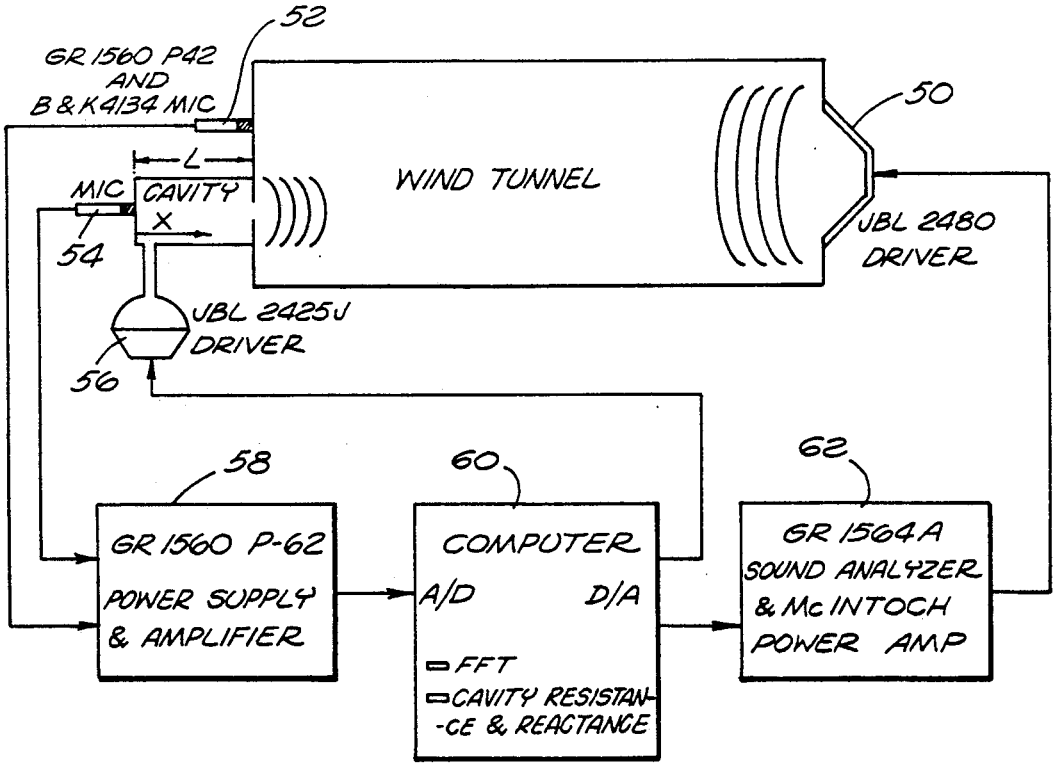
FIG. 2 is a block diagram of an experimental set-up used to verify the concepts of the present invention.

To verify the concepts of the invention, an experimental program wa undertaken to verify that the impedance of a Helmholtz resonator can be controlled by the invention. The experiments were conducted at a frequency sufficiently higher than the tuned frequency of the resonator to insure that the unmodified acoustic absorption of the resonator would be inefficient. The experimental set up, shown in FIG. 2, consisted of a Helmholtz resonator with a tuned frequency of 500 Hz positioned on a side wall of a wind tunnel structure. Standard acoustic techniques were used to measure the impedance of the Helmholtz resonator. As shown in FIG. 2, a JBL 2480 driver 50 was used to generate sound incident to the resonator orifice at a frequency of 1,000 Hz. A B&K 4134 microphone 52 located above the resonator measured the amplitude and phase of the incident sound pressure. Since the sound frequency was below the first cut-on mode of the wind tunnel cross section, only plain wave sound was excited. This avoided large phase and amplitude changes between the incident microphone location and the orifice. A second microphone 54 located at the back of the resonator measured the local amplitude and phase of the cavity sound pressure. Finally, a JBL 2425J driver 56 was used to generate a separate sound pressure within the cavity. The output of the microphone 54 as well as the output of the microphone 52 were coupled through General Radio 1560 P-62 power supplies and amplifiers 58, with the outputs thereof coupled to computer 60 through analog to digital converters. Outputs of the computer coupled through digital to analog converters were used to drive the driver 50 through a General Radio 1564A sound analyzer and Mc Intosh power amplifier 62, and to drive the driver 56 coupled to the Helmholtz resonator cavity.

The resonator geometry consisted of a 5.08 centimeter diameter cylindrical cavity of 3.4 centimeters in depth, an orifice diameter of 0.635 centimeters and a face sheet thickness of 0.076 centimeters. Tests were conducted that showed resonance of the Helmholtz resonator at 500 Hz at zero grazing flow and at an incident sound pressure level of 90 db. The resonator was installed along the side of the 127 centimeter by 254 centimeter wind tunnel and exposed to grazing flow speeds of up to 50 meters per second. For all grazing flow speeds tested, the boundary layers were turbulent and closely matched the classical 1/7th power law velocity profiles. The practical value of the invention was demonstrated by comparing the performance of the resonator with and without the cavity mounted speaker turned on. Because the incident speaker generated only plain wave sound, one dimensional acoustic theory was used to predict the sound absorption from the resonator even in the presence of grazing flow. From one dimensional acoustics, the sound energy absorbed $\alpha_R$ was expressed in terms of the resonator resistance and reactance as $$\alpha_R = -10 \text{ Log} \left[ \frac{\left(\frac{R}{\rho c} - 1\right)^2 + \left(\frac{X}{\rho c}\right)^2}{\left(\frac{R}{\rho c} + 1\right)^2 + \left(\frac{X}{\rho c}\right)^2} \right]$$

Figure 3:
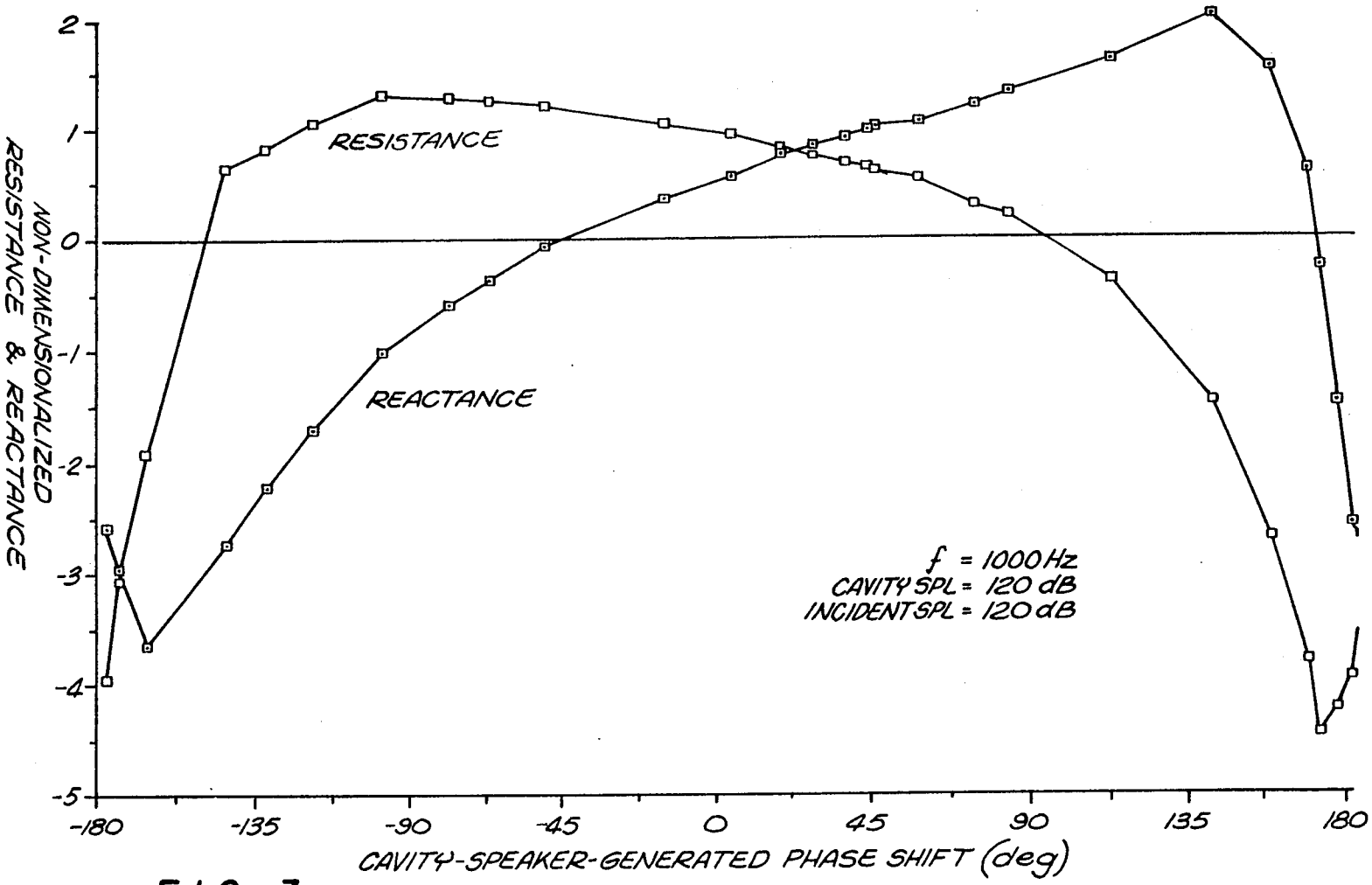
FIG. 3 is a plot showing typical resistance and reactance measurements using the test set-up of FIG. 2.
Figure 4:
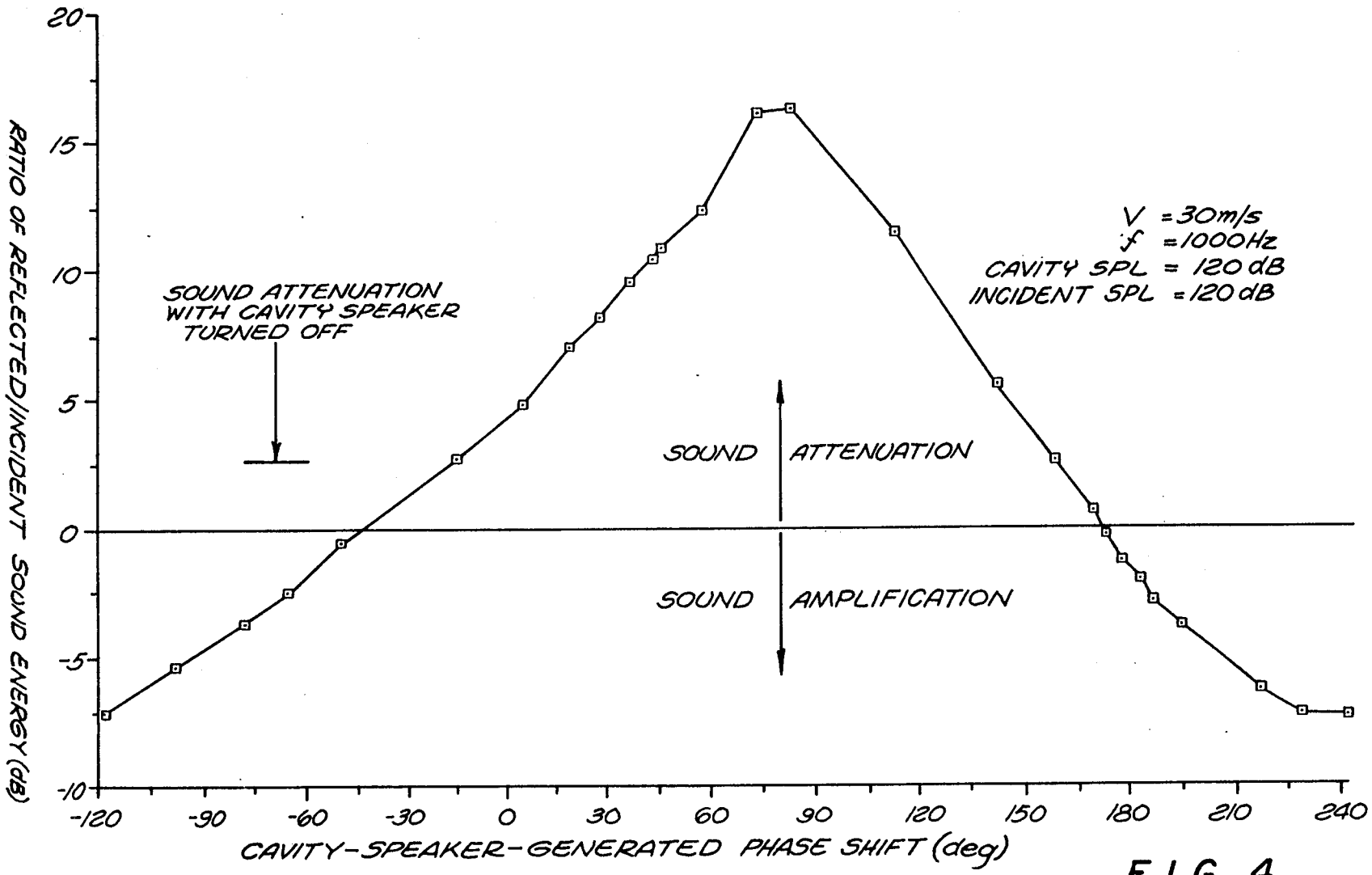
FIG. 4 is a plot showing the sound energy absorption versus the cavity speaker generated phase shift based on the measurements of FIG. 3.

With the cavity mounted speaker turned off, the nondimensional resistance and reactance were 1.106 and 2.504, respectively, at a grazing flow speed of 30 meters per second. Inserting these values into the foregoing equation yields $\alpha_R = 2.3$ dB. With the cavity mounted speaker generating 120 dB, the measured resistance and reactance values shown in FIG. 3 were inserted into the above equation, with the result shown in FIG. 4. Note that the performance of the off-tuned resonator was improved over half of the phase difference period and diminished over the other half. As noted before, one should be within plus or minus 30 degrees of the best phase, and preferably plus or minus 15 degrees of the best phase angle to be at or near the optimum attenuation. For some phase differences, the cavity mounted speaker 56 made the resonator generate sound, but at its optimal performance near a phase angle of 90 degrees, the resonator achieved approximately 16.1 dB attenuation compared to 2.3 dB attenuation without the cavity speaker control. This illustrates both the potential value of the invention, and the necessity of accurately controlling the phase difference introduced into the cavity of the cavity mounted speaker. Hence, in real applications such as aircraft engines and other rotating machinery noise control, etc., a certain amount of testing may be required to determine the various parameters involved to assure that the proper drive is supplied to the resonant cavity speaker for the conditions and geometries involved.

Also shown in FIG. 1, but not previously mentioned, is a temperature probe 64 which is also coupled to computer 44 for providing a measure of the air temperature thereto. In the laboratory set-up to verify the concepts of the present invention, the temperature of the air was substantially constant. However, in some applications, the temperature of the air may vary substantially. By way of example, in the case of a jet engine, the inlet air temperature on the ground may easily vary by 100 degrees Fahrenheit between warm and cold climates. On an absolute temperature scale, this variation may be plus or minus 10 percent or more. This has two primary effects, both relating to the variation in the speed of sound in proportion to the square root of the absolute temperature.

The first effect is a result of the change in the wave length of any particular frequency component with temperature on the meaning of the microphone signals. In particular, because the microphones 36 and 38, at least as shown in FIG. 1, are spaced away from wall 28, there will be a phase shift in any frequency component between the sensing of that frequency component by the microphone and the arrival of that component of the acoustic wave at the wall 28. That phase shift will depend upon that frequency component, which wavelength varies with temperature and the distance between the microphones and the wall, and accordingly the phase shift itself will vary with temperature. Similarly, the phase shift for both the incident wave and for the reflected wave between the two microphones 36 and 38 will vary with temperature, so that better separation of these two waves can be made in the analysis thereof if this variation is taken into account by the computer.

The second effect of the variation in the air temperature relates to the variation in the wave length of a particular frequency component with temperature in comparison to the size o characteristic dimensions of the apparatus in question. In particular, a noise source having appropriate frequency components within any form of enclosure or containment, such as an inlet duct, an outlet duct, etc., may excite standing waves therein. Since the standing waves depend upon an appropriate relationship between the wave length of a particular frequency component and the characteristic dimension of the containment, the frequencies which will most excite such standing waves will vary in proportion to the square root of the absolute temperature of the air. Accordingly, the drive provided to the resonant cavity should in many applications also be dependent upon the temperature of the air involved.

By way of a more specific example, one might have a turbine which may at any time operate between a lower angular velocity and a higher angular velocity, depending upon the demands thereon. In such a case, one can find the amplitude and phase of the best drive for a particular harmonic of the angular velocity, for each of various angular velocities between the two angular velocity extremes. Whatever the shape of the best amplitude drive versus angular velocity is measured for a particular harmonic of the angular velocity, one would expect that curve to generally shift upward in frequency as temperature of the air increases. Accordingly, temperature could be an important parameter in many applications. In such situations, one might be able to use the angular velocity of the equipment divided by the square root of the absolute temperature as a normalizing factor to reduce the amount of data required to provide optimum or near optimum drive to the acoustic cavity over a wide range of operating conditions, as such a factor appropriately compensates for the speed of sound change with respect to both microphone positioning and the characteristic dimensions of the enclosure.

In addition to temperature, other parameters may also be taken into effect and/or important. By way of example, again referring to turbine type equipment, namely, a compressor, the back pressure thereon, probably best expressed as the pressure ratio between the turbine outlet and the turbine inlet, may vary at least partially independently of turbine speed and/or temperature. Clearly, at least in many applications, one could easily test such equipment over a reasonable range of the variables involved to meet substantially any expected condition. Also, while references have been made herein to air, obviously the concepts of the present invention would apply equally to other gases or gaseous mixtures including, by way of example, industrial gases, fuel gases, combustion products and the like.

There has been described herein a new and unique method and apparatus for attenuation of sound as may be useful for the attenuation of sound generated by various types of equipment such as aircraft engines, turbines, fans, liquid and solid rockets, compressors and the like. In a typical application, the invention has a low power requirement because the energy density of the sound within the resonator cavity is high due to the small resonator cavity volume. Also, the response time of the system is fast because of the rapid response of the driver to the changing conditions. In that regard the driver can be made relatively small so as to be light and occupy little space, and may be constructed to survive most environments. Also, the physical configurations involved may be relatively complex, and may utilize tuned sound absorbing devices which deviate very substantially from the classical Helmholtz resonator configurations. Similarly, screens, filters, distributed openings, etc., may also be utilized over the resonator cavity or cavities. In that regard, it will be apparent from the foregoing that the present invention is readily adaptable to ducts of relatively complex shape, as the complex shape of the wall containing the openings for the resonators does not in itself require any special complication in the design of the acoustic driver for the resonator cavity. Further, since the acoustic driver for the cavity essentially forms the distant wall of the cavity, it is not only not directly subjected to the flow stream itself, but can be significantly physically removed therefrom and externally cooled if desired, so that the methods and apparatus of the present invention may readily be applied in hostile environments, such as applied to noise suppression in engine exhaust applications. Thus while the preferred embodiment of the present invention has been disclosed and described herein, it will be understood by those skilled in the art that various changes in form and detail may be made therein without departing from the spirit and scope thereof.

We claim:

1. An extended frequency range sound absorbing device for attenuating sound incident thereto comprising:

a sound absorbing resonator having a resonator cavity and at least one resonator cavity opening, together defining a resonant frequency;

a speaker means coupled to said resonator cavity to couple acoustic energy thereto;

microphone means external to said resonator cavity for providing a microphone means output responsive to the sound incident to said at least one resonator cavity opening of said sound absorbing resonator;

drive means for driving said speaker means; and control means having its output coupled to said drive means and having its input coupled to said microphone means external to said resonator cavity as the only microphone means coupled to said control means input for providing a signal to said drive means having frequency components in a frequency range near said resonant frequency responsive to said microphone means output, whereby the acoustic energy coupled to the resonator cavity will enhance the sound attenuation of the sound absorbing resonator for a substantial frequency band adjacent said resonant frequency of said sound absorbing resonator.

2. The extended frequency range sound absorbing device of claim 1 wherein said microphone means comprises two microphones, and wherein said control means is a means for separating the characteristics of the sound incident to said sound absorbing resonator from the sound reflected therefrom.

3. The extended frequency range sound absorbing device of claim 2 wherein said control means comprises a digital computer for taking the Fast Fourier transform of the incident sound wave and providing a signal to said drive means having frequency components, each having an amplitude and phase selected to enhance the attenuation of the corresponding frequency component in the incident sound.

4. The extended frequency range sound absorbing device of claim 3 wherein said sound absorbing resonator has a predetermined resonant frequency, and wherein said frequency components are in a frequency range near said predetermined resonant frequency.

5. The extended frequency range sound absorbing device of claim 1 further including sensor means for sensing at least one additional operating characteristic, said control means also being coupled to said sensor means for providing a signal to said drive means which is responsive to both said microphone means output and said sensor means.

6. The extended frequency range sound absorbing device of claim 5 wherein said sensor means is a means for sensing temperature.

7. Apparatus for attenuating sound comprising:

a wall against which the sound to be attenuated will be incident;

at least one opening in said wall coupled to an acoustic resonator cavity there behind, said opening and said cavity forming an acoustic resonator having an acoustic resonant frequency;

speaker means coupled to said cavity to couple acoustic energy thereto;

microphone means positioned adjacent said wall external to said resonator cavity for providing an output responsive to the sound incident thereto;

drive means for driving said speaker means; and control means having its output coupled to said drive means and having its input coupled to said microphone means external to said resonator cavity as the only microphone means coupled to said control means input, for providing a signal to said drive means having frequency components in a frequency range near said resonant frequency responsive to said microphone means output, whereby the acoustic energy coupled to the resonator cavity will enhance the sound attenuation of the sound absorbing resonator for a substantial frequency band adjacent said resonant frequency of said sound absorbing resonator.

8. The apparatus of claim 7 wherein said control means comprises a digital computer for taking the Fast Fourier transform of the incident sound wave and providing a signal to said drive means having frequency components, each having an amplitude and phase selected to the corresponding frequency component in the incident sound.

9. The apparatus of claim 8 wherein said opening in said wall and said cavity form a resonant system having a predetermined resonant frequency, and wherein said control means is a means for providing a signal having frequency components in a frequency range near said predetermined resonant frequency.

10. The apparatus of claim 8 wherein said microphone means comprises two microphones, and wherein said control means is a means for separating the characteristics of the sound incident to said wall from the sound reflected therefrom.

11. The apparatus of claim 7 further including sensor means for sensing at least one operating characteristic, said control means also being coupled to said sensor means, for providing a signal to said drive means which is responsive to both said microphone mean output and said sensor means.

12. The apparatus of claim 11 wherein said sensor means is a means for sensing temperature.

13. A method of attenuating sound comprising the steps of:

(a) disposing an acoustic resonator having a resonator cavity and an opening thereto so that the sound to be attenuated will be incident to the opening of the cavity, the cavity being otherwise closed;

(b) disposing microphone means adjacent and external to the cavity opening to be responsive to the sound incident thereto;

(c) coupling an acoustic driver to the resonator cavity to provide acoustic energy thereto; and (d) controlling the acoustic driver responsive only to said microphone means, whereby the acoustic energy coupled to the resonator cavity will enhance the attenuation of the sound incident to the acoustic resonator.

14. The method of claim 13 wherein the microphone means response is analyzed based on the frequency components therein, and wherein for each such frequency component and the amplitude thereof in the microphone means response, the acoustic driver is controlled in the amplitude and phase of a corresponding frequency component in the microphone means response based upon a predetermined relationship.

15. The method of claim 14 wherein the predetermined relationship is first determined by providing incident sound to the cavity opening having at least one predetermined frequency component therein and varying the amplitude and phase of the corresponding frequency component controlling the acoustic driver to determine the amplitude and phase which best attenuates that frequency component.

16. The method of claim 14 wherein the frequency components in the microphone means response are determined by taking the Fast Fourier transform thereof.

17. The method of claim 16 wherein said microphone means comprises two microphones disposed adjacent the cavity opening, the two microphones being separated from each other so as to be responsive to the same incident sound wave at different times, and wherein the responses of the two microphones are combined to separate the incident sound from the combination of incident and reflected sound in the response of each microphone prior to taking the Fast Fourier transform thereof.

18. The method of claim 13 wherein said microphone means comprises two microphones disposed adjacent the cavity opening, the two microphones being separated from each other so as to be responsive to the same incident sound wave at different times, and wherein the responses of the two microphones are combined to separate the incident sound from the combination of incident and reflected sound in the response of each microphone, and wherein step (d) comprises the step of controlling the acoustic driver responsive to the incident sound.

19. The method of claim 13 further comprised of the step of sensing one additional operating characteristic, and wherein step (d) comprises the step of controlling the acoustic driver responsive to both the microphone means and the at least one additional operating characteristic.

20. The method of step 19 wherein the at least one additional operating characteristic includes temperature.

21. An extended frequency range sound absorbing device for attenuating sound incident thereto comprising:

a sound absorbing resonator having a resonator cavity and at least one resonator cavity opening;

a speaker means coupled to said resonator cavity to couple acoustic energy thereto;

two microphone means for providing a microphone means output responsive to the sound incident to said sound absorbing resonator;

drive means for driving said speaker means; and control means coupled to said microphone means and said speaker means for separating the characteristics of the sound incident to said sound absorbing resonator from the sound reflected therefrom and for providing a signal to said drive means responsive to said microphone means output, whereby the acoustic energy coupled to the resonator cavity will enhance the sound attenuation of the sound absorbing resonator.

22. The extended frequency range sound absorbing device of claim 21 wherein said control means comprises a digital computer for taking the Fast Fourier transform of the incident sound wave and providing a signal to said drive means having frequency components, each having an amplitude and phase selected to enhance the attenuation of the corresponding frequency component in the incident sound.

23. The extended frequency range sound absorbing device of claim 22 wherein said sound absorbing resonator has a predetermined resonant frequency, and wherein said frequency components are in a frequency range near said predetermined resonant frequency.

24. The extended frequency range sound absorbing device of claim 21 further including sensor means for sensing at least one additional operating characteristic, said control means also being coupled to said sensor means for providing a signal to said drive means which is responsive to both said microphone means output and said sensor means.

25. The extended frequency range sound absorbing device of claim 24 wherein said sensor means is a means for sensing temperature.

26. Apparatus for attenuating sound comprising:

a wall against which the sound to be attenuated will be incident;

at least one opening in said wall coupled to a cavity therebehind, said opening and said cavity forming an acoustic resonator having a predetermined resonant frequency;

speaker means coupled to said cavity to couple acoustic energy thereto;

microphone means positioned adjacent said wall external to said cavity for providing an output responsive to the sound incident thereto;

drive means for driving said speaker means; and control means coupled to said microphone means and said speaker means for providing a signal to said drive means responsive to said microphone means and having frequency components in a frequency range near said predetermined resonant frequency, said control means having a digital computer for taking the Fast Fourier transform of the incident sound wave and providing a signal to said drive means having frequency components, each having an amplitude and phase selected to the corresponding frequency component in the incident sound, whereby the acoustic energy coupled to the cavity will attenuate the sound incident to the wall.

27. The apparatus of claim 26 wherein said microphone means comprises two microphones, and wherein said control means is a means for separating the characteristics of the sound incident to said wall from the sound reflected therefrom.

28. The apparatus of claim 26 further including sensor means for sensing at least one operating characteristic, said control means also being coupled to said sensor means, for providing a signal to said drive means which is responsive to both said microphone means output and said sensor means.

29. The apparatus of claim 28 wherein said sensor means is a means for sensing temperature.

30. Apparatus for attenuating sound comprising:

a wall against which the sound to be attenuated will be incident;

at least one opening in said wall coupled to an acoustic resonator cavity therebehind, said opening and said cavity forming an acoustic resonator having an acoustic resonant frequency;

speaker means coupled to said cavity to couple acoustic energy thereto;

two microphones positioned adjacent said wall external to said resonator cavity for providing an output responsive to the sound incident thereto;

drive means for driving said speaker means; and control means coupled to said microphones and said speaker means for separating the characteristics of the sound incident to said wall from the sound reflected therefrom and for providing a signal to said drive means having frequency components in a frequency range near said resonant frequency responsive to said microphone output, whereby the acoustic energy coupled to the resonator cavity will attenuate the sound incident to the wall for a substantial frequency band adjacent said resonant frequency of said sound absorbing resonator, wherein said control means comprises a digital computer for taking the Fast Fourier transform of the incident sound wave and providing a signal to said drive means having frequency components, each having an amplitude and phase selected to substantially attenuate the corresponding frequency component in the incident sound.

31. A method of attenuating sound comprising the steps of:

(a) disposing an acoustic resonator having a resonator cavity and an opening thereto so that the sound to be attenuated will be incident to the opening of the cavity, the cavity being otherwise closed;

(b) disposing two microphones adjacent the cavity opening to be responsive to the sound incident thereto, the two microphones being separated from each so as to be responsive to the same incident sound wave at different times;

(c) coupling an acoustic driver to the resonator cavity to provide acoustic energy thereto; and (d) controlling the acoustic driver responsive to the microphones wherein the microphone response is analyzed based on the frequency components therein as determined by taking the Fast Fourier transform thereof, wherein for each such frequency component and the amplitude thereof in the microphone response, the acoustic driver is controlled in the amplitude and phase of a corresponding frequency component in the microphone response based upon a predetermined relationship, and wherein the responses of the two microphones are combined to separate the incident sound from the combination of incident and reflected sound in the response of each microphone prior to taking the Fast Fourier transform thereof;

whereby the acoustic energy coupled to the resonator cavity will enhance the attenuation of the sound incident to the acoustic resonator.

32. A method of attenuating sound comprising the steps of:

(a) disposing an acoustic resonator having a resonator cavity and an opening thereto so that the sound to be attenuated will be incident to the opening of the cavity, the cavity being otherwise closed;

(b) disposing two microphones adjacent the cavity opening to be responsive to the sound incident thereto, the two microphones being separated from each so as to be responsive to the same incident sound wave at different times, the responses of the two microphones being combined to separate the incident sound from the combination of incident and reflected sound in the response of each microphone;

(c) coupling an acoustic driver to the resonator cavity to provide acoustic energy thereto; and (d) controlling the acoustic driver responsive to the incident sound, whereby the acoustic energy coupled to the resonator cavity will enhance the attenuation of the sound incident to the acoustic resonator.

33. Apparatus for attenuating sound comprising:

a wall against which the sound to be attenuated will be incident;

at least one opening in said wall coupled to a cavity therebehind, said opening and said cavity forming an acoustic resonator having an acoustic resonant frequency;

speaker means coupled to said cavity to couple acoustic energy thereto;

microphone means positioned adjacent said wall for providing an output responsive to the local sound;

drive means for driving said speaker means; and control means coupled to said microphone means and said speaker means for providing a signal to said drive means responsive to said microphone means and having frequency components in a frequency range at least near said predetermined resonant frequency, said control means having a digital computer for taking the Fast Fourier transform of the incident sound wave and providing a signal to said drive means having frequency components, each having an amplitude and phase selected to the corresponding frequency component in the incident sound;

wherein said control means is a means for separating the characteristics of the sound incident to said wall from the sound reflected therefrom;

whereby the acoustic energy coupled to the cavity will attenuate the sound incident to the wall.

* * * * *